United States Patent [19]

Corsette

[11] Patent Number: 4,496,082

[45] Date of Patent: Jan. 29, 1985

[54] LIQUID DISPENSING PUMP

[76] Inventor: Douglas F. Corsette, 6559 Firebrand St., Los Angeles, Calif. 90045

[21] Appl. No.: 469,118

[22] Filed: Feb. 23, 1983

Related U.S. Application Data

[63] Continuation-in-part of Ser. No. 332,338, Dec. 18, 1981, Pat. No. 4,410,107.

[51] Int. Cl.[3] ..... B67D 5/32

[52] U.S. Cl. ..... 222/153; 222/321; 222/384

[58] Field of Search ..... 222/153, 321, 384, 402.11, 222/380, 383, 401, 340–341, 372, 375, 382, 385; 239/331, 333

[56] References Cited

U.S. PATENT DOCUMENTS 3,333,549 8/1967 Cooprider ..... 222/383 X
3,827,605 8/1974 Knickerbocker ..... 222/153
3,827,606 8/1974 Knickerbocker ..... 222/153 X
3,908,870 9/1975 Nozawa et al. ..... 222/321
4,343,417 8/1982 Corsette ..... 222/153

*Primary Examiner*—Charles A. Marmor
*Attorney, Agent, or Firm*—Watson, Cole, Grindle & Watson

[57] ABSTRACT

A liquid dispensing pump is capable of being locked in one embodiment in a fully raised position of the plunger, in another embodiment in a fully depressed position of the plunger and in a further embodiment in a fully raised and/or fully depressed position of the plunger relative to the pump body. Each pump has a vent chamber which is closed in the locked position to avoid leakage of product from the container, and which is opened by a depending skirt on the plunger as it moves into juxtaposition to an enlarged diameter section in the vent chamber.

9 Claims, 16 Drawing Figures

10
11
12
13
14
15
16
17
18
19
21
22
23
24
25
26
27
28
29
31
32
33
34
35
36
37
38
39
41
42
43
44
45
46
47
48
49
51
52
53
54
55
56
57
58
3
4

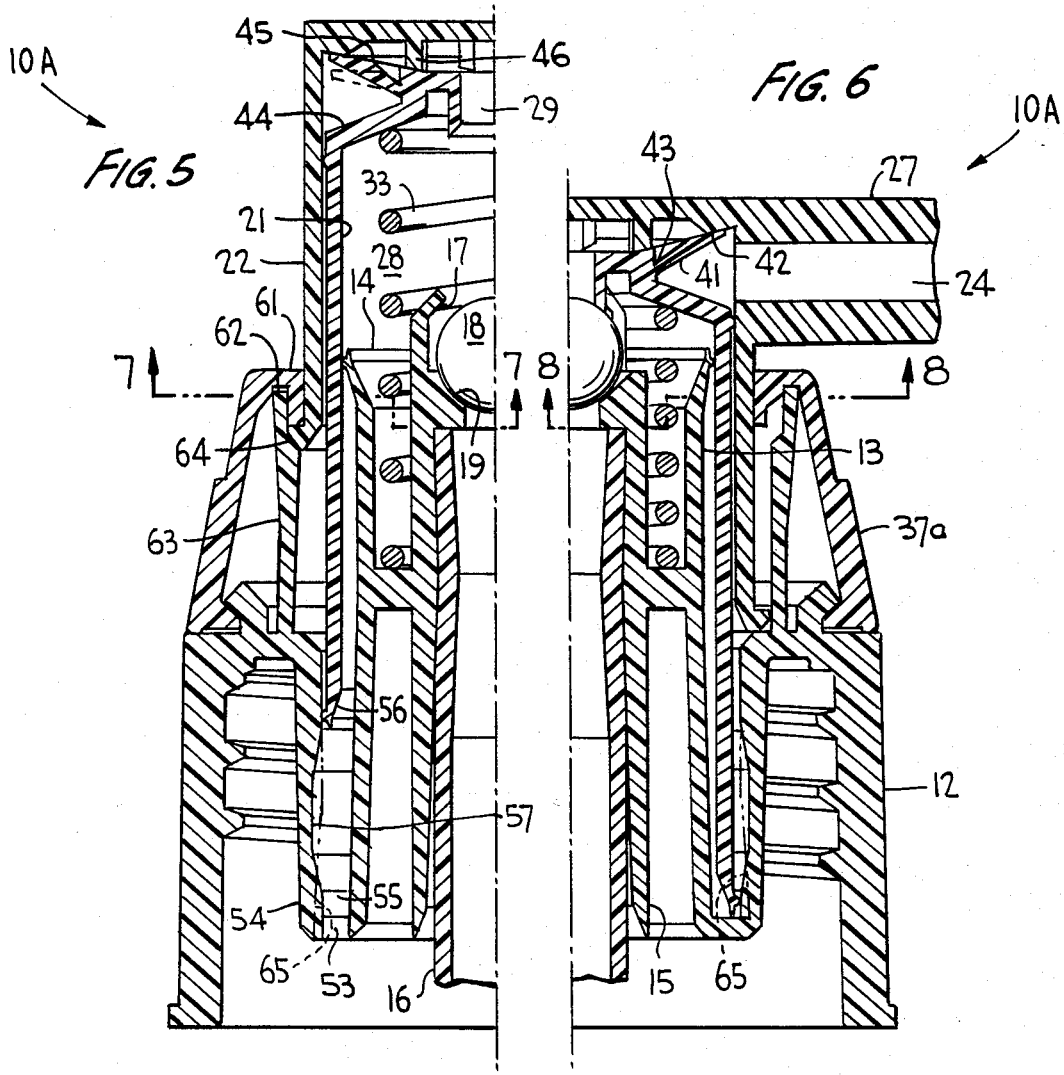
FIG. 5
FIG. 6
10A
10A
45
46
44
29
33
21
22
28
17
14
61
62
18
7
7
8
8
64
19
13
63
37a
56
12
57
55
54
65
53
16
15
65
43
27
41
42
24
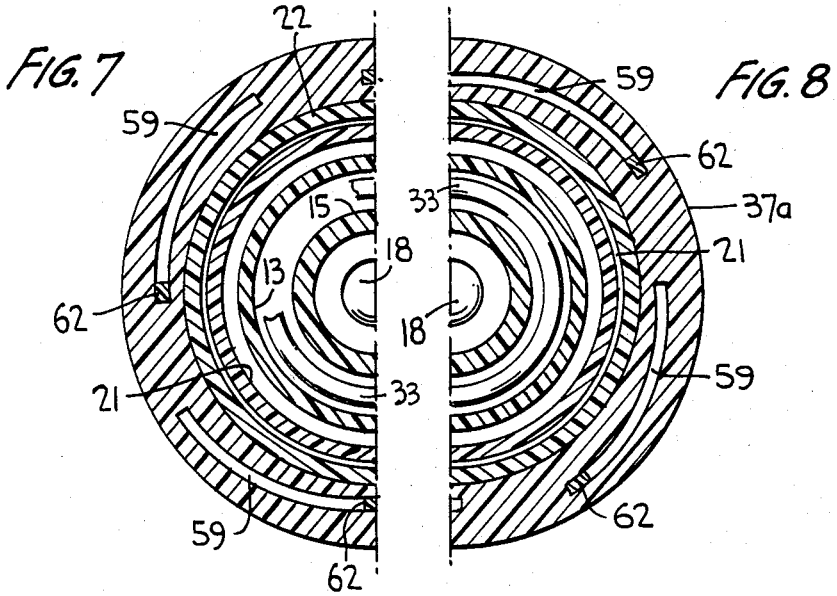
FIG. 7
FIG. 8
22
59
59
62
15
33
37a
18
21
13
62
18
21
33
59
59
62
62

10B
45
46
44
23
29
31
28
21
22
33
17
14
18
35
34
47
19
49
48
56
54
57
55
53
16
11
12
13
15
43
41
42
27
24
62
37b
63
52
51
59

LIQUID DISPENSING PUMP

RELATED APPLICATION

This application is filed as a continuation-in-part of U.S. Ser. No. 332,338, filed Dec. 18, 1981 now U.S. Pat. No. 4,410,107.

BACKGROUND OF THE INVENTION

This invention relates generally to a manually actuated dispensing pump having a reciprocable plunger operated by a surrounding plunger head capable of being selectively locked, in one embodiment, in a fully depressed position, and capable of being selectively locked in another embodiment, in a fully raised position relative to the pump body, any leakage of product through the pump being positively prevented in both such plunger locked positions.

The aforementioned application discloses a finger operated liquid dispensing pump having a plunger head capable of being locked down, in one embodiment, in a fully depressed position relative to the pump body in non-use conditions of shipping and storage. An annular upstanding lip seal on the pump body bears tightly against the inner surface of the plunger head in this lockdown position for sealing the container vent opening against leakage from the pump. However, no provision is made for avoiding leakage of product through the container vent opening in an unlocked position during periods of use as when the pump is tipped from its upright position.

In another embodiment disclosed in the aforementioned related application, the plunger head is capable of being locked in a fully raised position relative to the pump body, and a vent chamber is established for venting the interior of the container to atmosphere via the container vent opening located in the pump body, this vent chamber being closed by a depending skirt on the pump plunger in the fully raised and locked position of the plunger head.

My prior U.S. Pat. No. 4,343,417 discloses a dispensing pump of the pressure accumulating type capable of being locked in a fully raised position of the plunger head relative to the pump body, a vent chamber of the aforementioned type being established and being closed by an annular depending skirt on the plunger in the fully raised and locked position of the plunger head. This U.S. Pat. No. 4,343,417 was copending with the aforementioned related application, and is an improvement of my earlier U.S. Pat. No. 4,050,613 relating to a manually actuated dispensing pump of the pressure accumulating type having an accumulation chamber in communication with the pump chamber to effect discharge opening as the plunger is moved relative to the plunger head.

Also, my copending application Ser. No. 121,223, filed Feb. 13, 1980, now U.S. Pat. No. 4,402,432 constitutes an improvement over my U.S. Pat. No. 4,050,613 in that a vent chamber for plunger actuated pumps, incapable of being locked in any position, is established and is opened and closed during plunger reciprocation by an annular skirt depending from the plunger.

SUMMARY OF THE INVENTION

It is an object of the present invention to improve upon the dispensing pumps of my parent application Ser. No. 332,338 (U.S. Pat. No. 4,410,107) in a manner whereby the plunger head in one embodiment is capable of being locked in a fully depressed position relative to the pump body, or the plunger head in another embodiment is capable of being locked in a fully raised position relative to the pump body, or the plunger head in yet a further embodiment is capable of being locked in either a fully depressed or a fully raised position relative to the pump body, such that any leakage of product through the container vent is positively prevented in these locked plunger positions.

Another object of this invention is to provide such a dispensing pump wherein the plunger head for each of the plunger locked pumps is the same, as are the plungers as well as that portion of the pump body for each pump forming the pump chamber which is opened and closed by a skirt depending from the pump plunger. Similar parts between the three pump embodiments facilitates interchangeability of parts between pumps and simplifies and economizes fabrication and assembly of the pump parts.

A further object of the present invention is to provide such a dispensing pump wherein the lock-down version is rendered leakproof in the fully raised and unlocked position of the plunger head, by the provision of a spaced annular wall which surrounds the stationary piston and therewith defines the vent chamber, such wall having an enlarged or barrel-shaped central section presenting a gap with the plunger skirt and defining an open vent passage while at the same time permitting the vent chamber to be closed in the fully raised position as the plunger skirt engages this wall in such position.

A still further object of the invention is to provide such a dispensing pump wherein the lock-up version has a annular wall with an enlarged or barrel-shaped central section presenting a gap with the plunger skirt and thereby defining an open vent passage during pump operation.

A still further object of this invention is to provide such a dispensing pump wherein the annular wall defining the vent chamber may have, as an alternative, an enlarged upper portion for the lock-down version and an enlarged lower portion for the lock-up version, thereby providing alternative gaps with the plunger skirt for defining open vent passages during pump operation.

A still further object of the invention is to provide such a dispensing pump wherein the lock-up/lock-down version is rendered leakproof in both locked positions of the plunger head by the provision of the same annular wall having the barrel-shaped central section which defines the open vent passage while permitting the vent chamber to be closed in the plunger up and down locked positions.

Other objects, advantages and novel features of the invention will become more apparent from the following detailed description of the invention when taken in conjunction with the accompanying drawings.

BRIEF DESCRIPTION OF THE DRAWINGS

FIG. 5 is a vertical half-section of a dispensing pump according to another embodiment according to the invention, the plunger head being shown in its fully raised and locked position relative to the pump body;

FIG. 6 is view similar to FIG. 5 but with the plunger head shown in an unlocked and fully depressed position;

FIGS. 7 and 8 are sectional views respectively taken substantially along the lines 7—7 and 8—8 of FIGS. 5 and 6;

DETAILED DESCRIPTION OF THE INVENTION

Figures 1, 2, 3, 4:
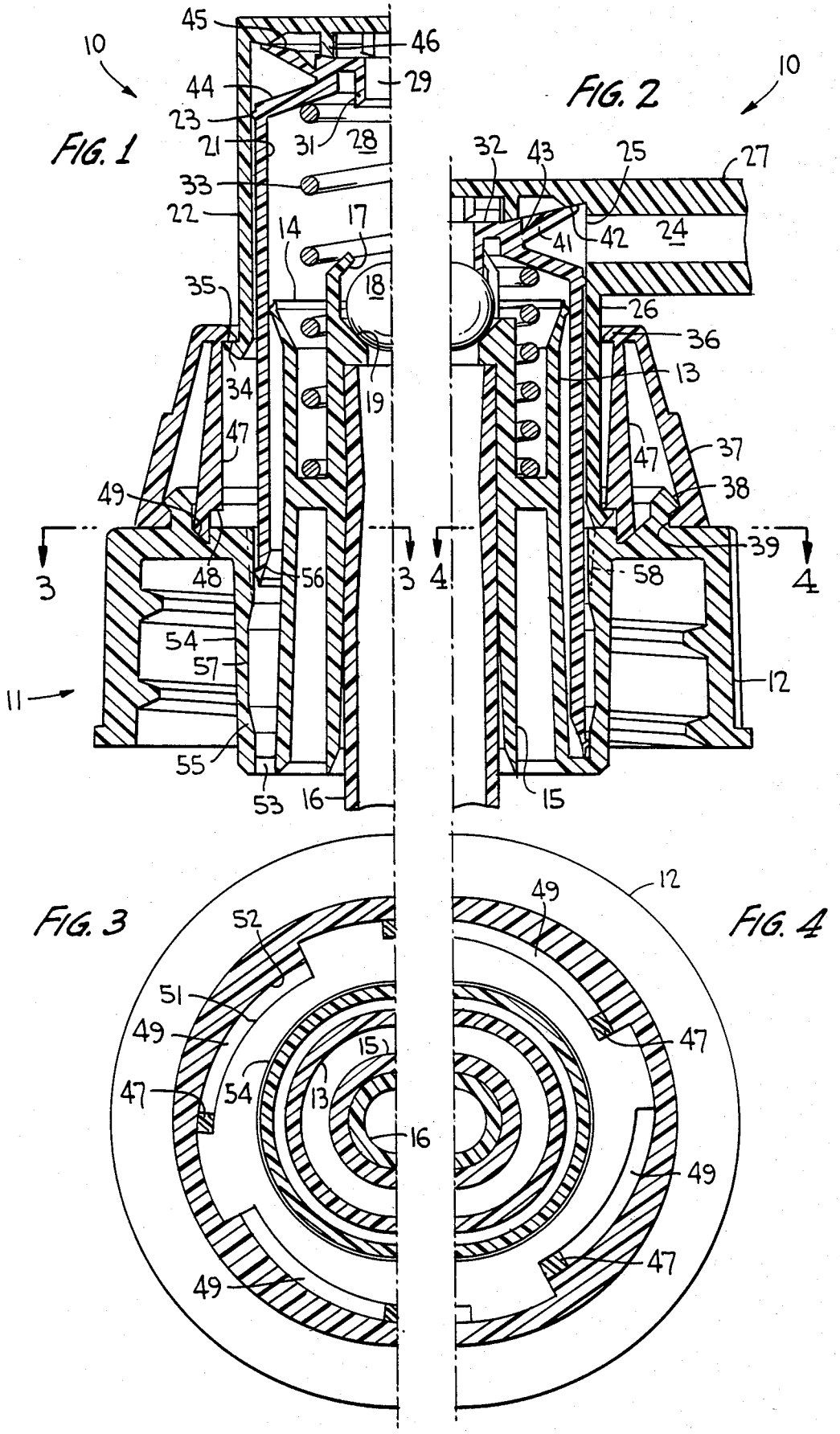
FIG. 1 is a vertical half-section of one embodiment of a dispensing pump according to the invention showing the plunger head in its fully raised and unlocked position.
FIG. 2 is a view similar to FIG. 1 showing the plunger head in its fully depressed and locked position on the pump body.
FIGS. 3 and 4 are respectively sectional views taken substantially along the lines 3—3 and 4—4 of FIGS. 1 and 2.
Figures 9, 10, 11, 12:
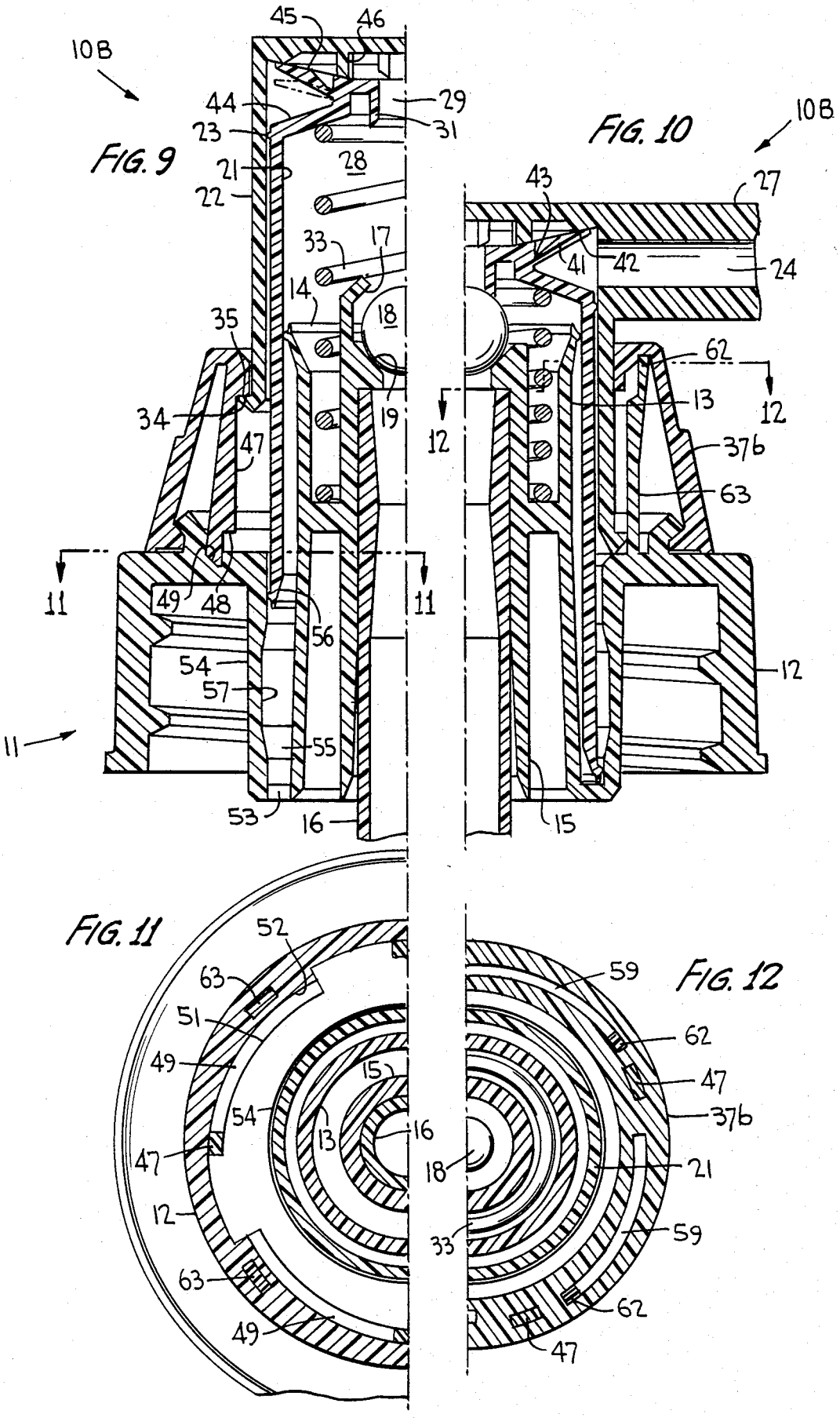
FIGS. 9 and 10 are views similar to FIGS. 1 and 6 of a further embodiment according to the invention, the plunger head being respectively shown unlocked in its fully raised and fully depressed positions.
FIGS. 11 and 12 are sectional views respectively taken substantially along the lines 11—11 and 12—12 of FIGS. 9 and 10.
Figure 13:
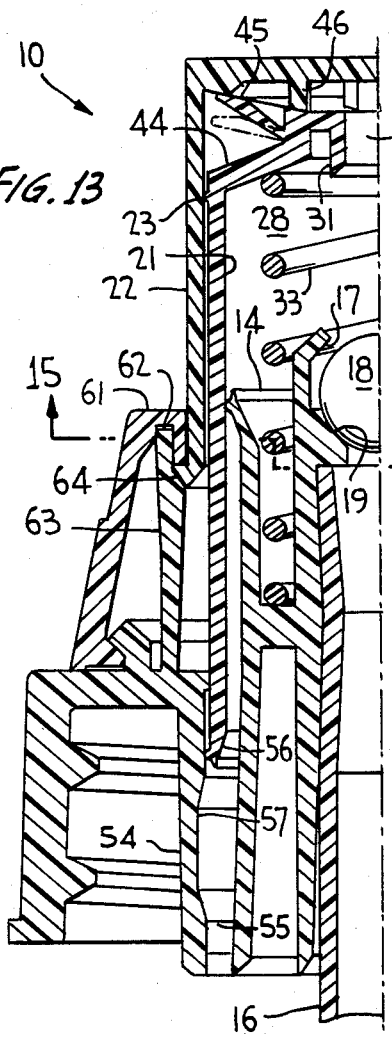
FIGS. 13 and 14 are views similar to FIGS. 5 and 2 of the further embodiment, the plunger head being respectively shown locked in its fully raised and fully depressed positions.
Figure 14:
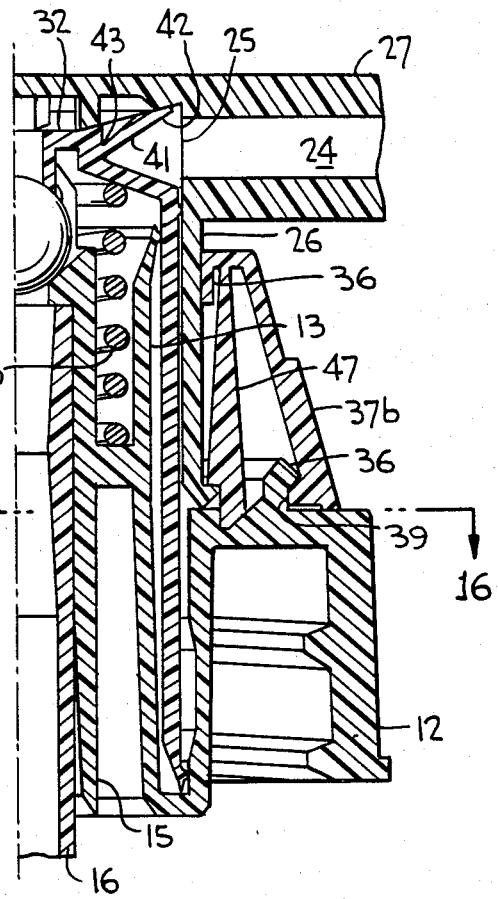
Figure 15:
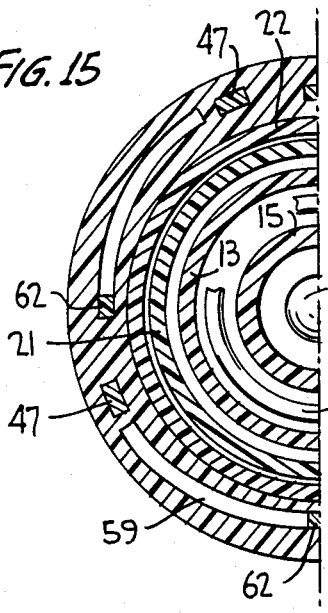
FIGS. 15 and 16 are sectional views respectively taken substantially along the lines 15—15 and 16—16 of FIGS. 13 and 14.
Figure 16:
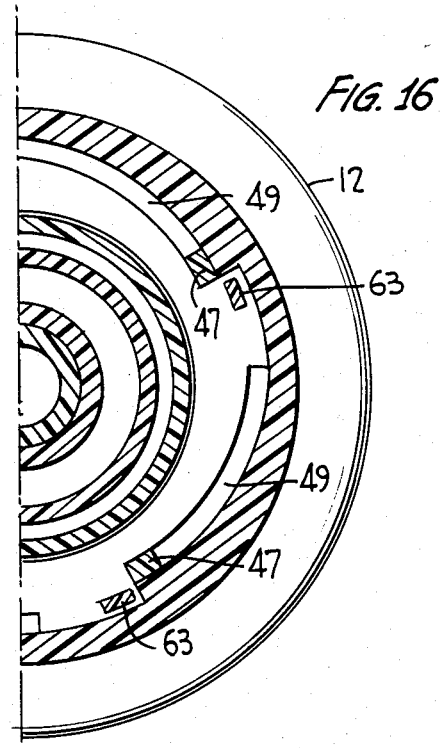

Turning now to the drawings wherein like reference characters refer to like and corresponding parts throughout the several views, a liquid dispensing pump is generally designated 10 in FIGS. 1 and 2, and is similar in many respects to the lock-down pump shown in my parent application Ser. No. 332,338 (U.S. Pat. No. 4,410,107). Thus, the pump comprises a pump body member 11 adapted to be secured for fluid tight communication with the opening of a container (not shown) of flowable product to be dispensed, an internally threaded cap 12 being provided for this purpose. The closure cap has mounted thereon a centrally disposed, stationary, upstanding piston 13 having an annular lip seal 14 at its upper end. An inner concentric post 15 of the piston supports the upper end of a dip tube 16 which is tightly received within the post and which extends into the container in the normal manner. Ball retention fingers 17 on the upper end of sleeve 15 are provided for capturing a ball check valve 18 during the suction or fill mode of the dispensing operation. And, the upper end of post 15 terminates in an inlet valve seat 19 against which the ball check valve is fully seated during the plunger compression stroke for closing the inlet during the dispensing operation.

A downwardly open, cup-shaped plunger 21 is slideably mounted for reciprocation on the piston, and a plunger head 22 overlies the plunger. The head may have a suitably formed finger piece on its upper end by which intermittent finger pressure may be conveniently applied to be transmitted to the plunger for producing reciprocation thereof on piston 13. An annular rib 23 on the plunger forms a packing gland so that the plunger may be sealingly received within the plunger head and be capable of relative movement thereto.

The discharge passage 24 in the plunger head has a discharge opening 25 located in a depending skirt 26 of the head and extending through a discharge spout 27 which communicates with the atmosphere. Relative axial movement between the plunger and the piston defines a variable volume pump chamber 28 with which the discharge passage communicates via an opening 29 located within a central, depending probe 31 on an upper wall 32 of the plunger. This probe engages and forces ball check valve 18 against its seat 19, and the ball valve will thus coact with both seat 21 and the free end of the probe to close off the passage of liquid through the inlet in the fully depressed position of the plunger shown in FIG. 2. A coil return spring 33 coacts between the piston and the underside of the plunger for urging the plunger head into its fully raised position of FIG. 1.

Thus, at the commencement of the priming and/or pumping operation, spring 33 maintains the plunger in its fully raised position of FIG. 1, the head being held against upward displacement by the interengagement of annular stop shoulders 34 and 35. Shoulder 35 is formed on an annular lug 36 projecting inwardly of a control member or ring 37 secured to the pump body member for relative rotary movement by means of cooperating annular lugs 38 and 39 respectively provided on the members.

The discharge valving may comprise an annular spring washer or flap valve 41 extending outwardly of upper wall 32 in a lateral direction relative to the axis of plunger reciprocation. Annular valve seat 42 is provided at the undersurface of the plunger head adjacent discharge opening 24. The spring washer functions as a bunsen valve which is self-biased against valve seat 42 at the upper surface of the valve in a direct communication with the pump chamber via opening 29. The root end of the valve is constricted by the provision of an annular groove 43 which defines a resilient hinge along which the valve moves, as shown in phantom outline in FIG. 1, during the plunger compression stroke. The upper surface of the plunger slopes downwardly and outwardly as at 44 to avoid any interference in a valve opening position.

Thus, with the pump fully primed, a downward stroke of the plunger head closes the inlet and effects an increase in pressure within the pump chamber so that liquid moves laterally from the pump chamber against surface 45 to move slightly away from its seat, thus allowing product to flow through the discharge opening and out of the discharge spout. The outer diameter of flap 41 is slightly less than the inner diameter of the plunger head to avoid interference during discharge opening and closing, and to provide a 360° peripheral flow passage from above flap 41 to below flap 41.

And, lateral spring washer 41 has its own elastic memory assuring a tight and leakproof seal during each suction stroke and during non-use. Nevertheless, the loading of the discharge valve may need to be controlled to assure resistance against leakage during shipping and storage. For this purpose, valve positioning lugs 46 of a predetermined extent are provided on the undersurface of the plunger head, or alternatively on the upper surface of the plunger. Upper wall 32 of the plunger strikes against these lugs at the end of the plunger upstroke, as shown in FIG. 1. Thus, for lugs 46 having a relatively shorter extent than shown, it can be seen that spring washer 41 would be induced with a heavier bearing pressure as it assumes a flatter disposition upon valve closing. The converse is true for lugs having a relatively longer extent. These lugs act as bearing blocks in opposition to the force of spring 33 and effectively limit the outer extent of the plunger during its return stroke. Thus, for different applications and needs, plunger heads having suitably sized lugs may be chosen without the need for substituting other parts of the apparatus.

Alternatively, the discharge valving may be in the form of that disclosed in either of my U.S. Pat. Nos. 4,050,613 or 4,343,417. There, an accumulation chamber is formed between the plunger and the plunger head, and is in communication with the pump chamber, the plunger shifting axially relative to the head upon an accumulation of pressure in the pump chamber to thereby open the discharge.

Plunger lock-down in its fully depressed position of FIG. 2 is effected by the provision of a plurality of locking fingers 47 depending from the upper end of control member 37. Stop shoulders 48 on the locking fingers are spaced from stop shoulders 34 thereon and are moved into locking engagement with shoulder 35 on the plunger head (FIG. 2) in a fully depressed position of the head. To effect such movement, the locking fingers are shifted inwardly, from their FIG. 3 to their FIG. 4 positions, by control member 37. For this purpose, cam grooves 49 are provided in the upper surface of cap 12 for each of the locking fingers of which there are four in number in the disclosed embodiment, although any reasonable number exceeding one may be provided. Each cam groove comprises a pair of opposing cam surfaces 51 and 52 for respectively locking and unlocking the plunger upon rotary movement of the control member as the locking fingers are positively deflected, together with their stop shoulders, transversely into as well as out of the path of stop shoulder 35. Thus, with the plunger depressed into its lowermost position of FIG. 2, with the lower ends of the locking fingers 47 lying in the FIGS. 1 and 3 positions, relative rotary movement of members 37 and 11 deflects the locking fingers transversely into their FIGS. 2 and 4 positions in which shoulders 35 and 48 interengage for positively locking down the plunger. With such an arrangement, it can be seen that any tendency to inadvertently unlock the plunger head is provided and any interference between the head and the locking fingers during plunger reciprocation is avoided.

A container vent opening 53 is provided in the pump body for admitting air into the container to replace product after each dispensing stroke to prevent hydraulic lock within the container. An annular wall 54, by means of which the piston is centrally mounted on the closure cap, is spaced from and surrounds the piston to therewith define a vent chamber 55 in open communication with the interior of the container via vent opening 53. The vent chamber, when opened, communicates with the atmosphere through the non-sealed engagement between lugs 34 and 35. The plunger has a depending, annular vent skirt 56 which extends into the vent chamber for closing and opening same, as will now be described.

Annular wall 54 has an enlarged inner diameter lying substantially between opposing ends of the wall so as to form a barrel shape as at 57. As shown in FIGS. 1 and 2, skirt 56 engages the inner surface of wall 54 in both the fully raised and the fully depressed positions of the plunger head to thereby close the vent chamber and to prevent any leakage of product from the container through the vent opening and out through the pump when the plunger is disposed in such positions. Thus, in the fully raised position of FIG. 1, leakage of product is prevented through the container vent opening in the event the pump is tilted sufficiently from its vertical position when in use. And, leakage of product through the container vent opening is likewise prevented in the fully depressed and locked down position of the plunger (FIG. 2), as when the pump is in a non-use condition of shipping and storage. Otherwise, during plunger reciprocation, vent skirt 56 opens the vent chamber as it lies juxtaposed to enlarged diameter 57 which presents a gap with the plunger and thereby defines an open vent passage.

Alternatively, the inner diameter of wall 54 may be enlarged as at 58 at its upper portion, such an enlargement being formed by a surface which extends gradually outwardly at its upper portion. The vent chamber is thereby opened in the FIG. 1 position and is closed as skirt 56 moves downwardly beyond enlargement 58. It can be seen that, with such alternative, vent chamber is not sealed closed in the fully raised position of the plunger during periods of use. The centrally disposed, barrel-shaped enlargement is therefore preferred for effecting the vent chamber opening and closing.

The FIG. 5 pump is generally designated 10A and is essentially the same as the aforedescribed pump. Similar parts will therefore be designated by the same reference numerals. The only difference between the pumps concerns the locking feature which in FIG. 5, permits the plunger head to be locked in an up position which is fully raised relative to the pump body. Thus, control member **37*a* is provided with a plurality of cam grooves 59 at the undersurface of its upper wall 61. Upper ends 62 of locking fingers 63 extending from the closure cap respectively engage these cam grooves so as to be thereby deflected transversely, from the FIGS. 5, 7 to the FIGS. 6, 8 positions, of the axis of reciprocation into and out of the path of reciprocation of the downwardly facing stop shoulder 64** on the plunger head.

As in the FIG. 1 pump, the inner surface of wall 54 of pump 10A is enlarged as at 57 to form a centrally located barrel-shape, this enlarged section forming a gap with vent skirt 56 when juxtaposed thereto during plunger reciprocation. This gap thereby defines an open vent passage permitting venting of the contents of the container to atmosphere. Thus, many of the parts between pumps 10 and 10A can be interchanged during assembly except for the control member and locking finger arrangement. Alternatively, wall 54 may have an inner diameter enlarged as at 65 at its lower end, such an enlargement being defined by a surface extending gradually outwardly at the lower portion of wall 54 so that a gradually increasing annular gap is formed between skirt 56 and this lower portion as the plunger approaches the end of its downstroke, as shown in FIG. 6.

Pump 10B of FIGS. 9 to 16 is essentially the same as pumps 10 and 10A so that similar parts are designated by the same reference numerals. The locking arrangement of pump 10B, however, combines together the locking features of pumps 10 and 10A so that the plunger can be locking in both its fully raised (FIG. 13) and its fully depressed (FIG. 14) positions without leakage of product from the container. Thus, a control member **37*b* is provided with cam grooves 59 at the undersurface of its upper wall 61, and with locking fingers 47 depending from wall 61 at locations lying between and avoiding interference with fingers 63 extending upwardly from the closure cap. The aforedescribed control members 37 and 37*a* are therefore combined into a single control member 37*b* which, when rotated about its central axis, functions the same for inwardly shifting FIGS. 47 from the FIG. 9 to the FIG. 14 position to lock the plunger in its fully depressed position, and for inwardly shifting ends 62 of fingers 63 from the FIG. 10 to the FIG. 13 position to lock the plunger in its fully raised position. The pump 10B plunger may thus be optionally locked, depending on the given needs and circumstances, in its fully raised and/or fully depressed positions relative to the pump body. And, as in pumps 10 and 10A, the central enlarged section 57 at the inner surface of wall 54 of pump 10B facilitates vent opening when vent skirt 56 is juxtaposed thereto during plunger reciprocation. The vent remains closed, and leakage of product from the container is prevented, in both the locked and unlocked fully raised and fully depressed positions of the plunger as the plunger skirt engages the inner surface of wall 54 above and below enlarged section 57. Thus, in order to leakproof the pump in both the fully raised and depressed plunger positions, enlarged diameters 58 and 65, optionally provided for pumps 10 and 10A, are not made available for pump 10B**.

Terms of orientation, such as "upstanding", "upper", "lower", "upward" and "depending", are used herein for clarity to identify the orientation relative to the drawings. These terms are therefore not intended to limit the scope of the invention or to exclude any equivalent structure.

Obviously, many other modifications and variations of the present invention are made possible in the light of the above teachings. For example, the vent skirt in each of the pump embodiments could alternatively depend from the plunger head for effecting the venting and leakproofing in an equivalent manner to that of the vent skirt which is presently disclosed as depending from the plunger head. It is therefore to be understood that within the scope of the appended claims the invention may be practiced otherwise than as specifically described.

What is claimed is:

1. A dispensing pump comprising, a pump body capable of being mounted on a container of product to be dispensed, a stationary piston having a valve-controlled inlet mounted on said pump body, finger actuacted plunger means mounted on said piston for sliding reciprocating engagement and forming a variable volume pump chamber therewith, said plunger means having a valve-controlled discharge passage, a return spring acting between said piston and said plunger means for urging said plunger means into a fully raised position above said body, a control ring rotatably mounted on said pump body and having means engaging said plunger means for limiting same in said fully raised position and having means for locking said plunger means at least in a fully depressed position relative to said pump body, a container vent opening in said pump body, an annular wall on said pump body spaced from said piston and therewith defining a vent chamber in open communication with the interior of the container via said vent opening, said plunger means having an annular skirt extending into said vent chamber for closing same at least in said depressed position and for opening said chamber in other than said fully depressed position, said skirt engaging a lower portion of said wall in said fully depressed position for closing said chamber, and said wall having means establishing an open vent passage with said skirt in said other than said fully depressed position for opening said chamber, whereby the interior of the container is vented to atmosphere in said other than said fully depressed position, and any leakage of product through said vent opening is positively prevented as said skirt engages said lower wall portion when said plunger means is locked in said fully depressed position.

2. The pump according to claim 1, wherein an upper portion of said wall has an enlarged inner diameter presenting a gap with said skirt and defining said means establishing said open vent passage.

3. The pump according to claim 1, wherein said wall has an enlarged inner diameter between said lower wall portion and an upper wall portion so as to present a gap with said skirt and defining said means establishing said open vent passage.

4. The pump according to claim 3, wherein said skirt also engages said upper portion of said wall in said fully raised position for closing said vent chamber and thereby preventing leakage of product through said vent opening.

5. The pump according to claim 1, wherein means are provided on said pump body engageable by said control ring for also locking said plunger means in a fully raised position relative to said pump body, said annular skirt engaging an upper portion of said annular wall in said fully raised position for closing said vent chamber, whereby any leakage of product through said vent opening is positively prevented as said skirt engages said upper wall portion when said plunger means is also locked in said fully raised position.

6. The pump according to claim 5, wherein said annular wall has an enlarged inner diameter between said upper and lower wall portions so as to present a gap with said skirt and defining said means establishing said open vent passage.

7. A dispensing pump, comprising, a pump body capable of being mounted on a container of product to be dispensed, a stationary piston having a valve-controlled inlet mounted on said pump body, finger actuated plunger means mounted on said piston for sliding reciprocating engagement and forming a variable volume pump chamber therewith, said plunger means having a valve-controlled discharge passage, a return spring acting between said piston and said plunger means for urging said plunger means into a fully raised position above said body, a control ring rotatably mounted on said pump body and having means engaging said plunger means for limiting same in said fully raised position, and means on said pump body engageable by said control ring for locking said plunger means in said fully raised position, a container vent opening in said pump body, an annular wall on said pump body spaced from said piston and therewith defining a vent chamber in open communication with the interior of the container via said vent opening, said plunger means having an annular skirt extending into said vent chamber for closing same in said fully raised position and for opening said chamber in other than said fully raised position, said skirt engaging an upper portion of said wall in said fully raised position for closing said chamber, and said wall having means establishing an open vent passage with said skirt in said other than said fully raised position for opening said chamber, whereby the interior of the container is vented to atmosphere in said other than said fully raised position, and any leakage of product through said vent opening is positively prevented as said skirt engages said wall when said plunger means is locked in said fully raised position.

8. The pump according to claim 7, wherein a lower portion of said wall has an enlarged inner diameter presenting a gap with said skirt and defining said means establishing said open vent passage.

9. The pump according to claim 7, wherein said wall has an enlarged inner diameter between said upper wall portion and a lower wall portion so as to presenr a gap with said skirt and defining said means establishing said open vent passage.

* * * * *